US012116161B2

(12) United States Patent
Yamaguchi et al.

(10) Patent No.: US 12,116,161 B2
(45) Date of Patent: Oct. 15, 2024

(54) VERTICAL BAG-MAKING/FILLING/PACKAGING MACHINE, MANUFACTURING METHOD OF FILM PACKAGING BAG WITH CONTENT, AND FILM PACKAGING BAG WITH CONTENT

(71) Applicant: ORIHIRO Engineering Co., Ltd., Tomioka (JP)

(72) Inventors: Akira Yamaguchi, Tomioka (JP); Kazuto Horiguchi, Tomioka (JP)

(73) Assignee: ORIHIRO ENGINEERING CO., LTD., Tomioka (JP)

( * ) Notice: Subject to any disclaimer, the term of this patent is extended or adjusted under 35 U.S.C. 154(b) by 0 days.

(21) Appl. No.: 18/558,838

(22) PCT Filed: Jan. 20, 2023

(86) PCT No.: PCT/JP2023/001626
§ 371 (c)(1),
(2) Date: Nov. 3, 2023

(87) PCT Pub. No.: WO2023/149228
PCT Pub. Date: Aug. 10, 2023

(65) Prior Publication Data

US 2024/0239535 A1 Jul. 18, 2024

(30) Foreign Application Priority Data

Feb. 1, 2022 (JP) ..... 2022-014142

(51) Int. Cl.
*B65B 9/20* (2012.01)
*B65D 30/00* (2006.01)
*B65D 75/58* (2006.01)

(52) U.S. Cl.
CPC ..... *B65B 9/20* (2013.01); *B65D 29/00* (2013.01); *B65D 75/5861* (2013.01)

(58) Field of Classification Search
CPC .... B65B 9/20; B65B 9/08; B65B 9/10; B65B 9/2014; B65B 9/2021; B65B 9/207; B65B 43/10

(Continued)

(56) References Cited

U.S. PATENT DOCUMENTS 3,426,499 A * 2/1969 Paige ..... B65B 9/2042 53/551
4,442,656 A * 4/1984 Wylie, Sr. ..... B65B 9/2042 53/552

(Continued)

FOREIGN PATENT DOCUMENTS

GB 2298850 A 9/1996
JP 2002-362508 A 12/2002

(Continued)

OTHER PUBLICATIONS

International Search Report dated Apr. 11, 2023, issued in counterpart Application No. PCT/JP2023/001626, with English translation. (16 pages).

(Continued)

*Primary Examiner* — Sameh Tawfik
(74) *Attorney, Agent, or Firm* — WHDA, LLP

(57) ABSTRACT

A vertical bag-making/filling/packaging machine includes: a top folding portion which forms a first fold by folding one of sides of a band-shaped film into a Z shape; a bottom folding portion which folds a center of the film so that side edges of the film face each other; a first pleat guide which pulls a first pleat of the first fold upright; a spout portion-forming portion which forms a spout portion between the side edges of the film; and a second pleat seal portion which (Continued)

forms a second pleat by heat-welding the side edges of the film together so as to make the film into a tube shape.

11 Claims, 11 Drawing Sheets

(58) Field of Classification Search
USPC ..... 53/451
See application file for complete search history.

(56) References Cited

U.S. PATENT DOCUMENTS

| | | | | |
|---|---|---|---|---|
| 4,532,754 | A * | 8/1985 | Hokanson | B65B 9/22 53/139.2 |
| 6,131,369 | A * | 10/2000 | Ausnit | B65B 9/213 53/139.2 |
| 8,142,078 | B2 * | 3/2012 | Matsunaga | B65D 75/44 383/66 |
| 8,376,923 | B2 * | 2/2013 | Nakagawa | B65B 61/28 493/186 |
| 8,776,484 | B2 * | 7/2014 | Kondo | B65B 9/207 493/437 |
| 9,238,537 | B2 * | 1/2016 | Edwards | B65B 51/303 |
| 10,981,347 | B2 * | 4/2021 | Brenkus | B31B 70/8133 |
| 11,052,628 | B2 * | 7/2021 | Shimoda | B65B 9/2042 |
| 2024/0116659 | A1 * | 4/2024 | Tsuruta | B65B 51/303 |

FOREIGN PATENT DOCUMENTS

| | | | |
|---|---|---|---|
| JP | 2009-208836 | A | 9/2009 |
| JP | 2009-220868 | A | 10/2009 |
| JP | 2011-006148 | A | 1/2011 |
| JP | 2020-055605 | A | 4/2020 |
| WO | 2020/100972 | A1 | 5/2020 |

OTHER PUBLICATIONS

Notice of Reasons for Refusal dated Jan. 30, 2023, issued in counterpart of Japanese Patent Application No. 2022-014142, with English Translation (10 pages).
Written Amendment dated Mar. 10, 2023, issued in counterpart of Japanese Patent Application No. 2022-14142, with English Translation (6 pages).
Written Opinion dated Mar. 10, 2023, issued in counterpart of Japanese Patent Application No. 2022-14142, with English Translation (6 pages).
Decision to Grant a Patent dated Mar. 27, 2023, issued in counterpart of Japanese Patent Application No. 2022-014142, with English Translation (5 pages).

* cited by examiner

VERTICAL BAG-MAKING/FILLING/PACKAGING MACHINE, MANUFACTURING METHOD OF FILM PACKAGING BAG WITH CONTENT, AND FILM PACKAGING BAG WITH CONTENT

TECHNICAL FIELD

The present invention relates to a vertical bag-making/filling/packaging machine or the like for manufacturing a film packaging bag in which a spout portion such as a mouth plug is disposed on the top of a pleat of a top gusset.

BACKGROUND ART

The vertical bag-making/filling/packaging machine forms a bag body from a band-shaped plastic film and fills a content in this bag body so as to continuously manufacture a film packaging bag with the content enclosed therein. The vertical bag-making/filling/packaging machine is often used for automatic packaging of food. It is also used for automatic packaging of detergents for baths, toilets and laundry.

As the film packaging bag filled with drinks, detergents and the like, a self-standing bag in which a gusset is provided on a bottom is manufactured. Such a packaging bag is called a standing pouch or the like and can be expected to have a strong display effect promoting sales because it can stand on its own on a display shelf.

The self-standing bag such as a standing pouch has an elliptic bottom and a flat top. Therefore, if they are packed upright in a cardboard box for transport, the loading efficiency (space capacity rate) is poor. Thus, a double-gusset bag with a gusset formed also on the top has been developed.

CITATION LIST

Patent Literature

Patent Literature 1: Japanese Patent Laid-Open No. 2009-208836

SUMMARY OF INVENTION

Technical Problem

For the conventional double-gusset bag, a bag-making process and a content-filling process are performed separately. Therefore, it is required to improve manufacture efficiency of the double-gusset bag by performing the bag-making and the filling at the same time by a vertical bag-making/filling/packaging machine.

In the gusset bag, a pair of pleats forming the gusset preferably have an accordion shape (bellow shape) with uniform folding width (depth from mountain folds to valley folds). This is because if the depths of the pair of pleats are different, it is difficult to stabilize the filling amount of the contents.

However, it was found that the uniform depth of the pair of pleats causes defective welding when a mouth plug or the like is disposed on the top (mountain fold) of one of the pleats by heat welding.

FIG. 11 schematically shows a heat-welding step of a mouth plug for a conventional vertical bag-making/filling/packaging machine.

As shown in FIG. 11, a film is placed on an outer surface (rear surface) side of the mouth plug, and three films are stacked on an inner surface (front surface) side of the mouth plug. Thus, the heating temperature on the outer surface side and that on the inner surface side are not uniform during the heat welding, resulting in defective welding.

Therefore, it is difficult to manufacture a film packaging bag in which the widths (folding widths) of the pair of pleats of the top gusset are uniform and the mouth plug or the like is disposed on the top of one of the pleats.

The present invention has an object to provide a vertical bag-making/filling/packaging machine or the like which can efficiently manufacture a film packaging bag in which a spout portion is disposed on the top of a pleat of a top gusset.

Solution to Problem

A vertical bag-making/filling/packaging machine according to an embodiment of the present invention includes: a top folding portion which forms a first fold by folding one of sides of a band-shaped film into a Z shape; a bottom folding portion which folds a center of the film so that side edges of the film face each other; a first pleat guide which pulls a first pleat of the first fold upright; a spout portion-forming portion which forms a spout portion between the side edges of the film; and a second pleat seal portion which forms a second pleat by heat-welding the side edges of the film together so as to make the film into a tube shape.

The spout portion-forming portion includes: a mouth plug supplying portion which disposes the mouth plug between the side edges of the film; and a mouth plug fusion portion which heat-welds the side edges of the film to the mouth plug together.

The second pleat seal portion includes: a pair of heater bars which heat-welds the side edges of the film with the mouth plug therebetween; and a pair of cooler bars which cools the mouth plug and the side edges of the film.

The first pleat guide presses an outer surface of the film toward an inner surface side to apply tension on the outer surface and release the tension on the first pleat so as to allow the first pleat to stand on its own.

The bottom folding portion has an out guide which makes sliding contact with the outer surface of the film to bring the sides of the film closer together. The first pleat guide consists of a film sliding contact surface of the out guide; and a slit groove which opens in the film sliding contact surface and extends in a direction crossing the film sliding contact surface so as to allow the first pleat to pass therethrough.

The vertical bag-making/filling/packaging machine includes a first pleat seal portion disposed between the top folding portion and the bottom folding portion for heat-welding the first pleat. The first pleat seal portion heat-welds a longitudinal center of the first pleat only at the top and both longitudinal ends from the top to a base.

The vertical bag-making/filling/packaging machine includes: a second pleat guide which tilts the first pleat toward the second pleat; and a top reinforcing seal portion which heat-welds both longitudinal ends of the first pleat and the second pleat together to form a top gusset.

The vertical bag-making/filling/packaging machine includes a pleat cutter which is disposed above the second pleat guide and cuts the first pleat in a transverse direction at regular intervals.

The vertical bag-making/filling/packaging machine includes a pleat supporter which supports the first pleat in an upright position when the pleat cutter cuts the first pleat.

The bottom folding portion forms a second fold by folding the center of the film into an M shape, and the vertical bag-making/filling/packaging machine comprises, below the bottom folding portion, a bottom seal portion which forms a bottom gusset by heat-welding the second fold.

The vertical bag-making/filling/packaging machine includes: a film supplying portion which supplies the film; a film conveying portion which conveys the film downward; a filling portion which discharges a fluid toward an inside of the film; a side seal portion which forms a bag body by heat-welding the film in a lateral direction; and a cutter portion which cuts off the bag body from the film.

The vertical bag-making/filling/packaging machine includes: a correcting portion which clamps the film in a front-back direction after introducing the fluid into the film so as to correct a filled shape of the film; and a squeezing roller portion which is disposed above the correcting portion and squeezes the film by pressing it in the front-back direction.

The film conveying portion includes: a driving roller in close contact with the film; and a drive rotation shaft which rotates the driving roller. The drive rotation shaft includes a rack gear which extends along an axial direction. The driving roller includes: a piece which meshes with the rack gear; a lever which moves the piece toward the rack gear; and a pressing spring which presses the lever toward the rack gear.

A first end of the lever is rotatably fixed to the driving roller, the piece is disposed near the first end, and the pressing spring presses a second end of the lever.

A method of manufacturing a film packaging bag with contents according to an embodiment of the present invention has: a top folding step in which a first fold is formed by folding one of sides of a band-shaped film into a Z shape; a bottom folding step in which a center of the film is folded so that side edges of the film face each other; a first pleat guide step in which a first pleat of the first fold is pulled upright; a spout portion-forming step in which a spout portion is formed between the side edges of the film; and a second pleat seal step in which a second pleat is formed by heat-welding the side edges of the film together so as to make the film into a tube shape.

The first pleat guide step presses an outer surface of the film toward an inner surface side to apply tension on the outer surface and release the tension on the first pleat so as to allow the first pleat to stand on its own.

The second pleat seal step has: a second pleat guide step in which the first pleat is tilted toward the second pleat; and a top reinforcing seal step in which both longitudinal ends of the first pleat and the second pleat are heat-welded together to form a top gusset.

The second pleat seal step has a pleat cutter step before the second pleat guide step, in which the first pleat is cut in a transverse direction at regular intervals.

The film packaging bag with contents according to the embodiment of the present invention is made by filling and enclosing a fluid in the film packaging bag, the film packaging bag including: a top gusset in which films on a top surface of the film packaging bag overlap in an M shape; a bottom gusset in which films on a bottom surface of the film packaging bag overlap in the M shape; and a spout portion disposed on a top on one of two pleats of the top gusset, and the two pleats have the same fold widths.

The longitudinal ends of the two pleats are connected to each other by heat welding.

The pleats have a seal which is formed by heat-welding the top thereof over a longitudinal direction.

The seal has an arc shape with a center in the longitudinal direction being recessed toward the top.

The spout portion is a plastic mouth plug which is disposed and fixed between the side edges of the film.

The spout portion has a cut-off piece formed by heat-welding side edges of the film, and the cut-off piece would be cut off for forming an aperture through which the fluid is taken out.

Advantageous Effects of Invention

The present invention makes it possible to efficiently manufacture the gusset bag in which the spout portion such as the mouth plug is disposed on the top of the pleat of the top gusset. Particularly, the spout portion such as the mouth plug can be well heat-welded to the film even if the fold widths of the two pleats of the top gusset are uniform (equal).

DESCRIPTION OF EMBODIMENTS

A vertical bag-making/filling/packaging machine 1 and a manufacturing method of a film packaging bag G with contents according to an embodiment of the present invention will be described below.

[Film Packaging Bag G with Contents]

Figure 1:
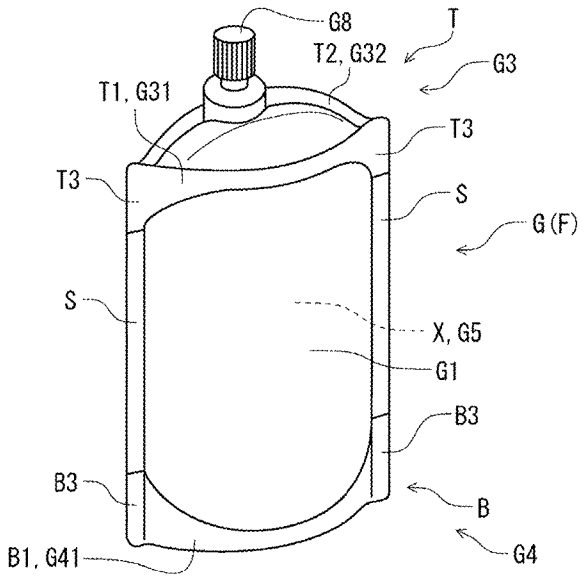
FIGS. 1(*a*)-1(*b*) are views illustrating a film packaging bag G with contents according to an embodiment, in which FIG. 1(*a*) is a perspective view from an upper front direction, and FIG. 1(*b*) is a perspective view from a lower rear direction.
Figure 1:
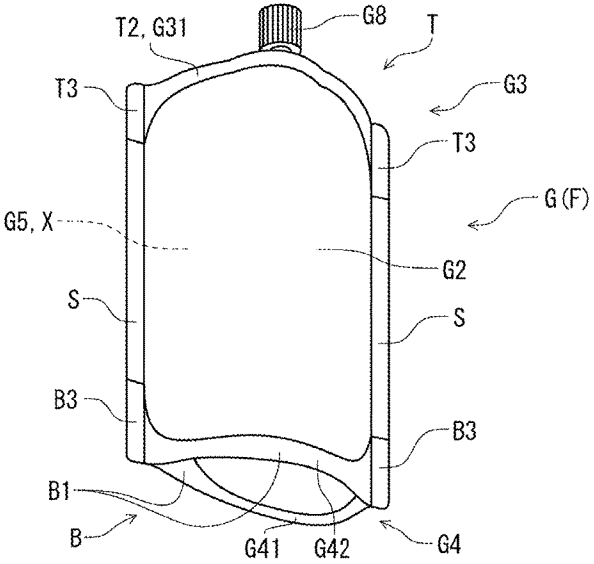

FIGS. 1(*a*)-1(*b*) are views illustrating a film packaging bag G with contents, and FIG. 1(*a*) is a perspective view from an upper front direction.

The film packaging bag G with contents is a bag body formed from a single plastic film F, which is filled with a content X. The film F is a laminated film in which high-strength films of nylon, polyester, and the like are laminated.

The film packaging bag G is a so-called double-gusset bag and has a top gusset G3 on a top surface (upper part) and a bottom gusset G4 on a bottom surface (lower part).

A height direction when the film packaging bag G with contents is in an upright position is also referred to as an up-down direction. A width direction of the film packaging bag G with contents is also referred to as a left-right direction. A thickness direction (expanding direction) of the film packaging bag G with contents is also referred to as a front-back direction. With respect to the front-back direction, a side of a surface on which the mouth plug G8 is disposed (rear surface G2) is referred to a rear.

The top gusset G3 has a first pleat G31 and a second pleat G32. The first pleat G31 and the second pleat G32 have the same shape (rectangle). The first pleat G31 and the second pleat G32 have the same length in the left-right direction and the uniform (same) width (fold width, depth) in the left-right direction. A mouth plug G8 is disposed on a top (mountain fold) of the second pleat G32 on the rear side.

The bottom gusset G4 has a first pleat G41 and a second pleat G42. The first pleat G41 and the second pleat G42 have the same shape (rectangle). The first pleat G41 and the second pleat G42 have the same length in the left-right direction, and their widths in the up-down direction (fold width, depth) are uniform (the same) over the left-right direction.

The left and right ends of the top gusset G3 and the bottom gusset G4, respectively, are welded. That is, the left and right ends of the first pleat G31 and the second pleat G32, respectively, are connected, and the left and right ends of the first pleat G41 and the second pleat G42, respectively, are connected. Therefore, the film packaging bag G has a substantially elliptic columnar shape. In other words, the film packaging bag G has a section in a horizontal direction with a convex-lens shape or an almond shape.

The top gusset G3 has a top seal T formed along an outer peripheral edge of the top surface. The top seal T consists of by three seals (a seal T1, a seal T2, and a seal T3).

The seal T1 is formed by heat-welding an upper end (mountain fold F3) of a front surface GT (the first pleat G31) of the film packaging bag G.

The seal T2 is formed by heat-welding upper ends (both side edges E1 and E2) of a rear surface G2 (the second pleat G32) of the film packaging bag G. A plastic mouth plug G8 is disposed on the center of the seal T2 in the longitudinal direction (the left-right direction of the film packaging bag G). The mouth plug G8 is heat-welded on the central top of the second pleat G32 of the top gusset G3.

The mouth plug (spout portion) G8 consists of a nozzle which communicates with the internal space (accommodating portion G5) of the film packaging bag G and a cap which can be screwed onto the nozzle, and a bottom end of the nozzle is sandwiched and heat-welded between the side edges E1 and E2 of the film F. The film packaging bag G with contents is opened by removing the cap from the nozzle of the mouth plug G8.

The seal T3 is formed by heat-welding left and right ends of an upper part of the film packaging bag G (overlapping portion in which the film F is four-folded). The seal T3 connects (fixes) the left and right ends of the first pleat G31 and the second pleat G32, respectively, to each other.

The bottom gusset G4 has a bottom seal B formed along an outer peripheral edge of the bottom surface. The bottom seal B consists of three seals (a pair of seals B1, and a seal B3).

The pair of seals B1 are formed by heat-welding lower ends of each of the front surface G1 (the first pleat G41) and the rear surface G2 (the second pleat G42) of the film packaging bag G. The pair of seals B1 have the same shape and are formed at the same time.

The seal B3 is formed by heat-welding the left and right ends of a lower part of the film packaging bag G (overlapping portion in which the film F is four-folded). The seal B3 connects (fixes) the left and right ends of the first pleat G41 and the second pleat G42, respectively, to each other.

When a sealant layer of the film F is disposed only on one surface (inner surface), the outer surfaces of the film F cannot be heat-welded even if the film F is four-folded. Thus, the first pleat G41 and the second pleat G42 are separated from each other. In order to make the film packaging bag G stable in an upright position, the left and right ends of the first pleat G41 and the second plate G42, respectively, need to be connected to each other.

Thus, punching holes may be provided in the portions where the outer surfaces of the film F are overlapped. The punching holes are provided on each outer surface so as to face each other when folded. As a result, even if the film F is four-folded, the inner surfaces (sealant layers) of the film F are brought into close contact with each other via the punching hole, whereby they are favorably heat-welded.

The bottom seal B (seals B1 and B3) is formed with a wider seal width than the top seal T (seals T1, T2 and T3) to support (reinforce) the film packaging bag G with contents in an upright position.

In the film packaging bag G, portions (top surface and bottom surface) surrounded by the top seal T and the bottom seal B function as a folding gore of the film packaging bag G.

The film packaging bag G has a pair of side seals S extending in the up-down direction on the left and right ends. The side seal S has an upper end connected to the seal T3 of the top seal T and a lower end with the seal B3 of the bottom seal B.

Since the film packaging bag G has a folding gore on the top surface (the top gusset G3) and a folding gore on the bottom surface (the bottom gusset G4), it is likely to expand in the front-back direction so that the internal space (an accommodating portion G5) accommodating a content X can be made larger.

The accommodating portion G5 is a non-sealed portion (cylindrical film) of the film packaging bag G which is not heat-welded and is a space in which the content X is filled and enclosed. The accommodating portion G5 communicates with the mouth plug G8 disposed on the central top of the first pleat G32 of the top gusset G3.

The content X is a liquid or a paste-state (semi-solid) beverage, food, chemical product, or the like. Specifically, the content X is a fluid such as drinking water, jelly, household detergents, and shampoo.

[Vertical Bag-Making/Filling/Packaging Machine 1]

Figure 2:
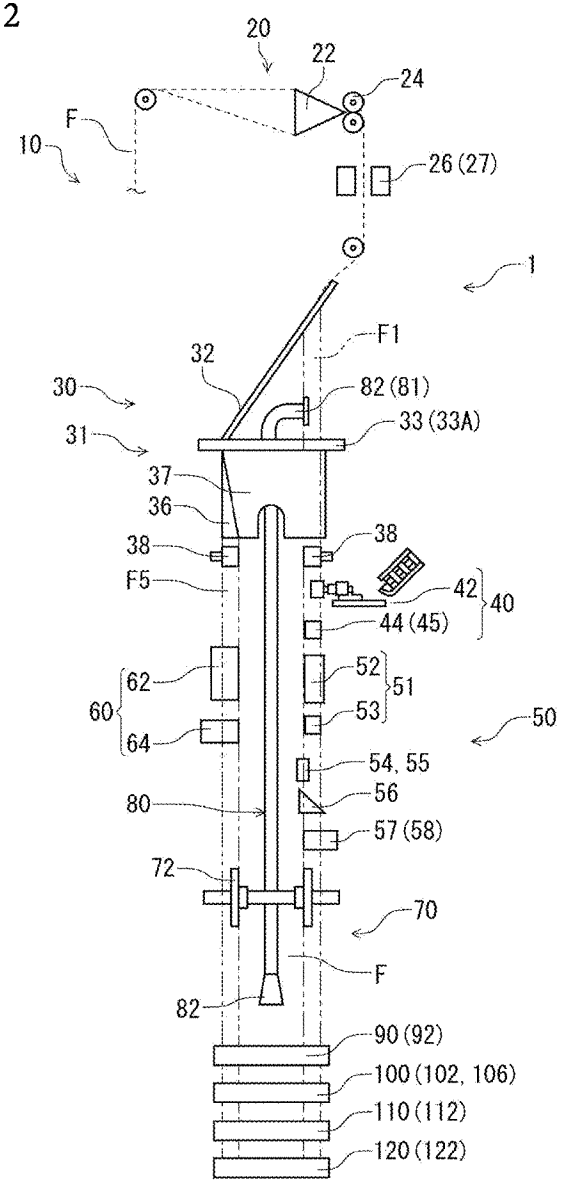
FIG. 2 is a front view illustrating a schematic configuration of a vertical bag-making/filling/packaging machine 1 according to the embodiment.

FIG. 2 is a front view illustrating a schematic configuration of a vertical bag-making/filling/packaging machine 1 according to an embodiment.

Figure 3:
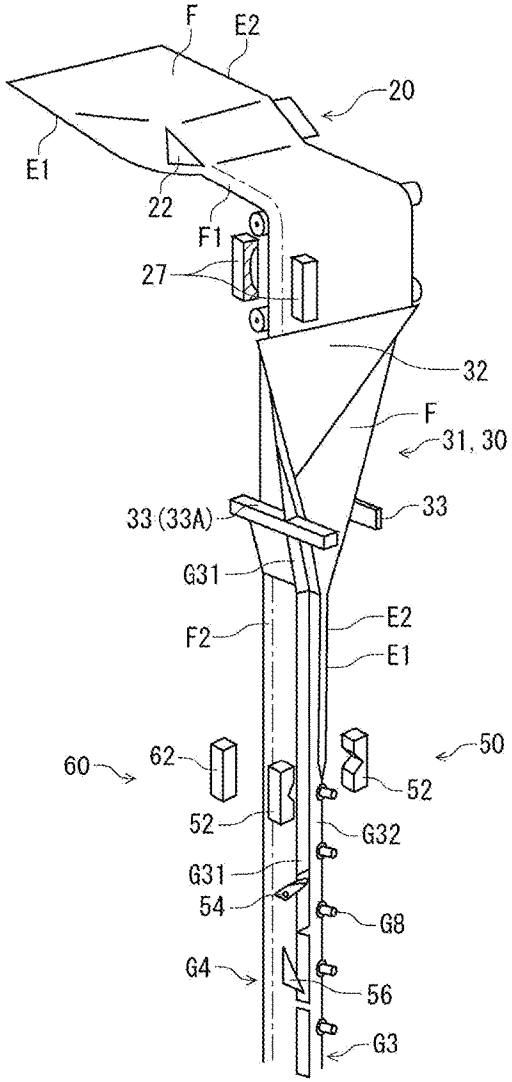
FIG. 3 is a perspective view from an upper front direction illustrating the bottom folding unit 30 and the like of the vertical bag-making/filling/packaging machine 1.

FIG. 3 is a perspective view from an upper front direction illustrating the bottom folding unit 30 and the like of the vertical bag-making/filling/packaging machine 1. For convenience of explanation, a part of the bottom folding unit 30, a mouth plug mounting portion 40, a filling portion 80 and the like are omitted in FIG. 3.

The vertical bag-making/filling/packaging machine 1 forms a film packaging bag G of a double-gusset type from a band-shaped film F and fills a content X in this film packaging bag G at the same time.

The vertical bag-making/filling/packaging machine 1 fills the content X while intermittently conveying the film F downward under control by a control portion (not shown). The vertical bag-making/filling/packaging machine 1 fills the content X substantially fully so as to leave as little air as possible in the film packaging bag G.

The vertical bag-making/filling/packaging machine 1 manufactures the film packaging bag G with contents without variation in the filled amount of the content X while continuously filling the content X.

It should be noted that the vertical bag-making/filling/packaging machine 1 may or may not include a measuring portion for measuring a filled amount of the content X and a shutter valve for adjusting the filled amount.

A longitudinal direction of the film F is also referred to as a conveying direction. A width direction of the film F is also referred to as a lateral direction. A thickness direction of the film F is also referred to as an overlapping direction.

The perpendicular direction in the vertical bag-making/filling/packaging machine 1 is also referred to as an up-down direction or a vertical direction. The upper side is also referred to as upstream, and the lower side is also referred to as downstream.

The lateral direction in the vertical bag-making/filling/packaging machine 1 is also referred to as a right-and-left direction.

A direction orthogonal to each of the up-down direction and the left-right direction is referred to as a front-back direction. With respect to the front-back direction, a direction away from the film F is referred to as an outer side or an outer surface side, and a direction closer to the film F is referred to as an inner side or an inner surface side.

The vertical bag-making/filling/packaging machine 1 includes: a film supplying portion 10; a top folding unit 20; a bottom holding unit 30; a mouth plug mounting portion 40; a top seal portion 50; a bottom seal portion 60; a film conveying portion 70; a filling portion 80; a squeezing roller portion 90; a correcting portion 100; a side seal portion 110; a cutter portion 120; and the like.

[Film Supplying Portion 10]

The film supplying portion 10 lets out the film F from the roll (not shown) and passes it through the plurality of driven rollers and the like. The film supplying portion 10 feeds out the film F under a constant tension applied so that it is not deflected or meandered. The film supplying portion 10 supplies the film F towards the top folding unit 20.

[Top Folding Unit 20]

The top folding unit (top folding portion) 20 is disposed diagonally to the upper right of the film supplying portion 10. The top folding unit 20 folds the band-shaped film F into a Z shape (N shape). Aside of the film F in the width direction (a side edge E1 side) is folded into the Z shape, whereby a fold F1 for the top gusset is formed.

The fold (first fold) F1 for the top gusset consists of a valley fold F2 on the side edge E1 side of the film F and a mountain fold F3 on a center side and is also referred to as three-fold. In the fold F1 for the top gusset, one side of the first pleat G31 and one side of the second pleat G32 are formed at the same time.

The top folding unit 20 includes a folding-plate portion 22, a pair of pressing rollers 24, and a first pleat seal portion 26.

The folding-plate portion 22 has a plurality of plate members extending along a conveying direction (right direction) of the film F. The film F slides along these plate members. The folding-plate portion 22 pushes and bends a side of the film F (a side edge E1 side) downward, further pushes it toward the center, and then folds it into the Z shape. The film F is folded so that a width from the valley fold F2 to the mountain fold F3 is substantially the same as a width from the valley fold F2 to the side edge E1. The first pleat G31 and the second pleat G32 are formed to have substantially the same width (uniform depth).

The pair of pressing rollers 24 is a pair of driven rollers disposed on a downstream of the folding-plate portion 22. The pair of pressing rollers 24 presses a portion folded into the Z shape in the up-down direction (overlapping direction) and creases the film F (the fold F1 for the top gusset).

The pair of pressing rollers 24 changes the conveying direction of the film F downward. The film F is fed to the downward direction via the pair of pressing rollers 24.

The first pleat seal portion 26 heat-welds the mountain fold F3 of the fold F1 for the top gusset so as to form the seal T1. The first pleat seal portion 26 forms the seal T1 on the top of the first pleat G31 or the like.

The first pleat seal portion 26 has a first pair of top heater bars 27. The first pair of top heater bars 27 is a pair of members which extends in the up-down direction, and is disposed to face each other with sandwiching the film F (a fold F1 for the top gusset) in the front-back direction. The first pair of top heater bars 27 clamps the fold F1 for the top gusset in the front-back direction and heat-welds the first pleat G31 over the up-down direction so as to form the seal T1.

The seal T1 is formed with a width in the up-down direction being small at the center and large on the both ends. The seal T1 is formed only on the top at the center in the up-down direction of the first pleat G31 while it is formed from the top to the base on the upper and lower ends.

As shown in FIG. 1, the seal T1 is formed over the entire length in the left-right direction of the first pleat G31 when the film packaging bag G is in an upright position, and has an arc shape with the center in the left-right direction being recessed toward the upper direction (top). As a result, the film F is fed toward the downstream while maintaining the shape of the first pleat G31 without deflection or meandering during the conveyance.

[Bottom Folding Unit 30]

Figure 4:
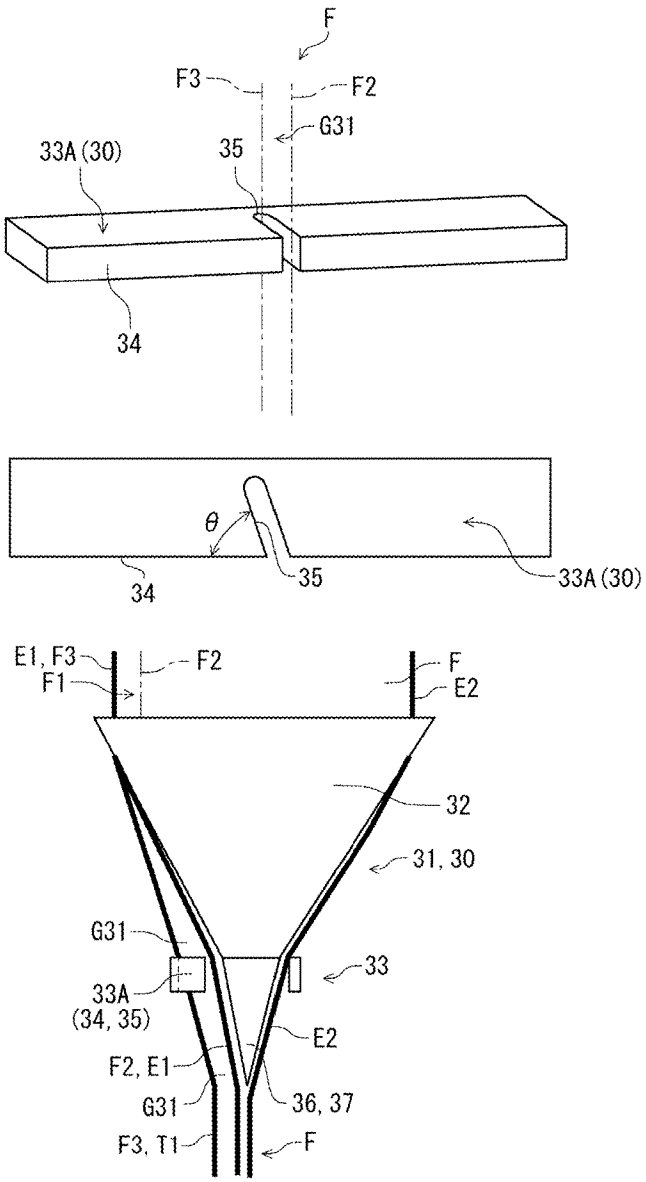
FIG. 4 (*a*) is a perspective view illustrating an out guide 33A, FIG. 4 (*b*) is a plan view of the out guide 33A, and FIG. 4 (*c*) is a right-side view illustrating a conveyance route of the film F in a bottom folding unit 30.

FIG. 4(*a*) is a perspective view illustrating an out guide 33A, and FIG. 4(*b*) is a plan view of the out guide 33A. FIG. 4(*c*) is a right-side view illustrating a conveyance route of the film F in a bottom folding unit 30. For convenience of explanation, the side edges E1 and E2 and the mountain fold F3 are shown in bold in FIG. 4(*c*).

The bottom folding unit (the bottom folding portion) 30 is disposed immediately below the top folding unit 20. The bottom folding unit 30 folds the band-shaped film F into an M shape (W shape). The center of the film F in the width direction is folded into the M shape, whereby a fold F5 for the bottom gusset is formed.

The fold (second fold) F5 for the bottom gusset consists of a valley fold F6 at the center of the film F and a pair of mountain folds F7 on both sides thereof and is also referred to as a bellow fold. In the fold F5 for the bottom gusset, the first pleat G41 and the second pleat G42 are formed at the same time.

The bottom folding unit 30 includes a folding-plate portion 31 and two pairs of pressing rollers 38.

The folding-plate portion 31 has a trapezoidal plate 32, an out guide 33, a pushing plate 36, and a holding plate 37 and slides the film F along these plurality of plate members.

First, the folding-plate portion 31 pushes both sides of the film F toward the inner surface side (right side) by the inverted-trapezoid-shaped trapezoidal plate 32 and the out guide 33 so as to make the film F into a U shape. Furthermore, the folding-plate portion 31 pushes the center of the film F toward the right side (inner surface side) by the pushing plate 36 and the pair of holding plates 37 so as to fold it into an M shape (W shape). Thus, the fold F5 for the bottom gusset is formed on the left side of the film F.

In the fold F5 for the bottom gusset, the first pleat G41 and the second pleat G42 are formed at the same time. The fold F5 for the bottom gusset is folded so that the widths from the valley fold F6 to the mountain folds F7 are substantially the same. The first pleat G41 and the second pleat G42 of the fold F5 for the bottom gusset are formed to have the same width (uniform depth).

The out guide 33 is a pair of rectangular bar-shaped members which extends in the left-right direction and are spaced apart in the front-back direction. An inner surface (the film sliding contact surface 34) of each out guide 33 is in sliding contact with an outer surface of the side of the film F and presses the side of the film F in the front-back direction (toward the inner surface). The out guide 33 brings the sides of the film F closer to each other and causes the sides of the film F to face each other so that the side edges E1 and E2 are aligned.

The out guide 33 presses the sides of the film F toward the inner surface side so as to guide the film F downward while applying tension to the film F.

The out guide 33 is not limited to a rectangular bar-shaped member and may be around bar-shaped member or the like. The out guide 33 is not limited to a bar and may be a sheet metal or the like bent in an L shape, a U shape, or the like.

As shown in FIG. 4(*a*) of the pair of out guides 33, the out guide 33A disposed in the forward direction has a slit groove 35 opening in the film sliding contact surface 34.

As shown in FIG. 4(*b*), the slit groove 35 extends in a direction crossing the film sliding contact surface 34 (the forward direction) and penetrates the out guide 33 in the up-down direction. The angle θ of the slit groove 35 with respect to the film sliding contact surface 34 is approximately from about 50° to 70°. The angle θ is preferably 60°. The width of the slit groove 35 is, for example, 3 mm. The slit groove 35 may be wide on the film sliding contact surface 34 and gradually narrow toward the forward direction.

The angle θ and the width of the slit groove 35 are set so that the first pleat G31 is not subjected to external force when passing through the slit groove 35. The optimum angle θ, width, length and the like of the slit groove 35 are adjusted according to the hardness and thickness of the film F, the folding amount of the first pleat G31, and the like.

The first pleat G31 of the fold F1 for the top gusset is inserted through the slit groove 35. As a result, the first pleat G31 is fed downward without being pressed by the out guide 33 toward the inner surface side.

The film sliding contact surface 34 (the first pleat guide) applies tension onto the side of the film F (the outer surface excluding the first pleat G31) by pressing it toward the inner surface side, while the slit groove 35 (the first pleat guide) releases the tension on the first pleat G31. Thereby the first pleat G31 stands by its own (actively stands up).

As shown in FIG. 4(*c*), the conveyance route for the film F has a curved arc shape in which one side (the side edge E1) is recessed inward (toward the rear side), and the first pleat G31 (the seal T1) has the shape of the chord of this curved arc. That is, the conveyance route for the first pleat G31 is on the outer side (forward side) than that of the side of the film F and is thereby shortened. The difference between the conveyance routes allows the first pleat G31 to naturally stand up.

Thus, the out guide 33 pulls the first pleat G31 upright without applying external force to the first pleat G31. The first pleat G31 is separated from the second pleat G32 (the side edge E1 of the film F). That is, the film sliding contact surface 34 and the slit groove 35 act as a guide for pulling the first pleat G31 upright.

Then, the film F is fed downward with the first pleat G31 standing up.

The pair of pressing rollers 38 consists of two pairs of driven rollers disposed on a downstream of the folding-plate portion 31.

The pair of pressing rollers 38 disposed on the right side in FIG. 2 clamps the side edges E1 and E2 of the film F in the front-back direction (overlapping direction) and brings them into close contact with each other.

The pair of pressing rollers 38 disposed on the left side in FIG. 2 presses a portion folded into an M shape in the front-back direction (overlapping direction) and creases the film F (forms the fold F5 for the bottom gusset).

Then, the pair of pressing rollers 38 feeds the film F downward.

[Mouth Plug Mounting Portion 40]

The mouth plug mounting portion (spout portion-forming portion) 40 is disposed on the lower right side of the bottom folding unit 30. The mouth plug mounting portion 40 includes a mouth plug supplying portion 42 and a mouth plug fusion portion 44 disposed on the lower right side of the bottom folding unit 30 (pair of pressing rollers 38).

The mouth plug supplying portion 42 supplies and arranges a plastic mouth plug G8 between the side edges E1 and E2 of the film F. The mouth plug supplying portion 42 temporarily separates the side edges E1 and E2 of the film F from each other and disposes the mouth plugs G8 therebetween at regular intervals.

The mouth plug fusion portion 44 heat-welds the mouth plug G8 (the bottom end of the nozzle) to the side edges E1 and E2 of the film F so as to mount the mouth plug G8 on the film F.

The mouth plug fusion portion 44 has a pair of heater bars 45 extending in the up-down direction, which are disposed to face each other with sandwiching the side edges E1 and E2 of the film F in the front-back direction.

The pair of heater bars 45 has a depression in the center in the up-down direction, and the side edges E1 and E2 of the film F and the mouth plug G8 (the bottom end of the nozzle) are overlapped and clamped at the depression.

The pair of heater bars 45 heat-welds the side edges E1 and E2 and the mouth plug G8 and mounts the mouth plug G8 on the film F. The pair of heater bars 45 simultaneously heat-welds the side edges E1 and E2 together on both upper and lower sides of the mouth plug G8. The mouth plug fusion portion 44 also forms a part of the seal T2 in the film F.

[Top Seal Portion 50]

The top seal portion 50 is disposed below the mouth plug mounting portion 40.

The top seal portion 50 heat-welds the side edges E1 and E2 of the film F to form the seal T2. By forming the seal T2 in the film F, the second pleat G32 is assembled, and the film F is made into a tube shape at the same time.

Moreover, the top seal portion 50 heat-welds the upper and lower ends of the first pleat G31 and the second pleat G32 (overlapping portion in which the film F is four-folded), respectively, to form the seal T3 and assembles the top gusset G3.

The top seal portion 50 includes a second pleat seal portion 51, a pleat cutter 54, a second pleat guide 56, a top reinforcing seal portion 57, and the like.

The second pleat seal portion 51 forms the seal T2 in the film F and assembles the second pleat G32.

The second pleat seal portion 51 has a second pair of top heater bars 52 and a pair of top cooler bars 53 disposed immediately below the pair of pressing rollers 38.

The second pair of top heater bars 52 is a pair of members which extends in the up-down direction, and is disposed to face each other with sandwiching the side edges E1 and E2 of the film F in the front-back direction. The second pair of top heater bars 52 has a depression in the center in the up-down direction and holds the mouth plug G8 mounted on the film F (side edges E1 and E2) at the depression.

The second pair of top heater bars 52 heat-welds the side edges E1 and E2 of the film F together over the up-down direction to form the seal T2. Simultaneously, the mouth plug G8 is reheated. As a result, the second pleat G32 on which the mouth plug G8 is mounted is assembled. At the same time, the film F is made into a tube shape.

The pair of top cooler bars 53 is disposed immediately below the second pair of top heater bars 52. The pair of top cooler bars 53 is a member having substantially the same shape as the pair of heater bars 45 of the mouth plug fusion portion 44, and coolant is supplied to the inside thereof.

The pair of top cooler bars 53 clamps the mouth plug G8 in the front-back direction and cools the mouth plug G8. As a result, the heat welded part between the mouth plug G8 and the side edges E1 and E2 of the film F is rapidly solidified, and the mouth plug G8 is completely fixed to the film F.

Figure 5:
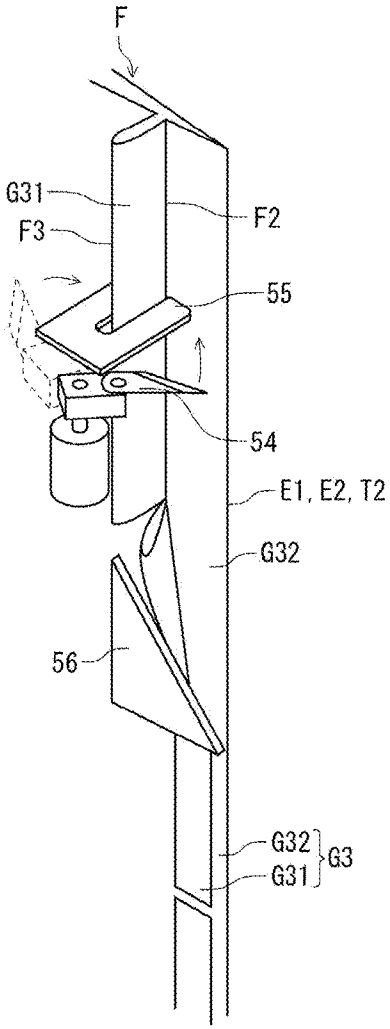
FIG. 5 is a perspective view from an upper front direction illustrating a pleat cutter 54, a pleat supporter 55, and a second pleat guide 56.

FIG. 5 is a perspective view from an upper front direction illustrating a pleat cutter 54, a pleat supporter 55, and a second pleat guide 56. For convenience of explanation, the mouth plug G8 and the like are omitted in FIG. 5.

The pleat cutter 54 is disposed on the lower front side of the pair of top cooler bars 53. The pleat cutter 54 swings a cutter left and right to cut the first pleat G31 in the transverse direction (horizontal direction). The pleat cutter 54 makes cutting lines from the top to the base of the first pleat G31 at regular intervals (length matching the width of the film packaging bag G) in the up-down direction.

A pleat supporter 55 is attached on the pleat cutter 54 for supporting the first pleat G31 in an upright position. The pleat supporter 55 is a U-shaped plate member fixedly disposed immediately above the pleat cutter 54. The pleat supporter 55 clamps the first pleat G31 in the left-right direction and guides the first pleat G31 toward the pleat cutter 54. The first pleat G31 is supported (held) in a forward upright position by the pleat supporter 55.

Since the pleat supporter 55 supports the first pleat G31 in a forward position, the pleat cutter 54 can favorably cut the first pleat G31.

The second pleat guide 56 is a plate member disposed below the pleat cutter 54 and pushes the first pleat G31 down toward the second pleat G32. Since the cutting lines extending in the transverse direction are formed on the first pleat G31 at regular intervals, the first pleat G31 is smoothly pushed down by the second pleat guide 56.

Further, the second pleat guide 56 pushes the first pleat G31 down to the right side to overlap the first pleat G31 and the second pleat G32 in close contact.

The top reinforcing seal portion 57 has a third pair of top heater blocks 58 disposed immediately below second pleat guide 56. The third pair of top heater blocks 58 is a pair of trapezoidal-shaped plate members and disposed to face each other with sandwiching the first pleat G31 and the second pleat G32 of the film F in the front-back direction.

The third pair of top heater blocks 58 heat-seals the upper and lower ends of the first pleat G31 and the second pleat G32 to form the seal T3. As a result, an overlapping portion in which the film F is four-folded is heat-welded, and the top gusset G3 is assembled.

The tube-shaped film F having the top gusset G3 is formed by the film F going through the top seal portion 50.

[Bottom Seal Portion 60]

The bottom seal portion 60 is disposed on the left side of the top seal portion 50. The bottom seal portion 60 heat-welds the fold F5 for the bottom gusset to form the bottom seal B. The bottom seal portion 60 assembles the bottom gusset G4 having the first pleat G41 and the second pleat G42.

The bottom seal portion 60 includes a first pair of bottom heater bars 62 disposed in parallel with the second pair of top heater bars 52 and a second pair of bottom heater bars 64 disposed immediately below it.

The first pair of bottom heater bars 62 clamps each of the pair of mountain folds F7 of the fold F5 for the bottom gusset (the first pleat G41 and the second pleat G42) and heat-welds them so as to form a pair of seals B1.

The second pair of bottom heater bars 64 clamps the upper and lower ends of the first pleat G41 and the second pleat G42, respectively, and heat-welds them so as to form the seal B3. Then, the overlapped portion in which the film F is four-folded is heat-sealed, and the bottom gusset G4 is assembled.

The tube-shaped film F having the bottom gusset G4 is formed by the film F going through the bottom seal portion 60.

[Film Conveying Portion 70]

The film conveying portion 70 is disposed below the top seal portion 50 and the bottom seal portion 60 and intermittently conveys the film F downward.

The film conveying portion 70 includes four driving rollers 72. The driving rollers 72 are disposed on the right side and the left side of the film F, respectively, with the film F sandwiched therebetween. These four driving rollers 72 is rotated while clamping the film F in the front-back direction and feeds the film F downward.

Figure 6:
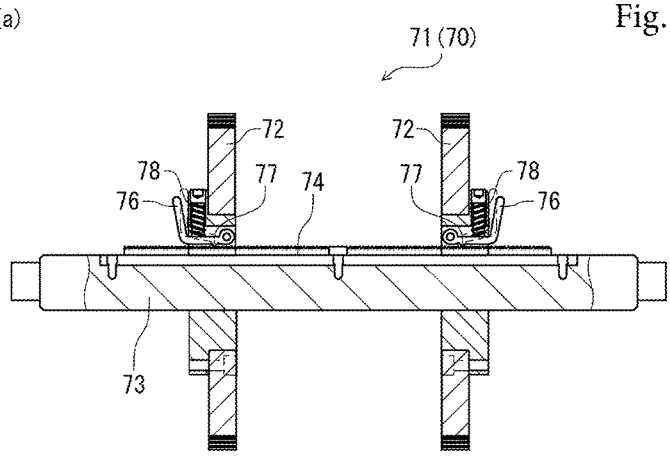
FIGS. 6 (*a*)-6 (*b*) are views illustrating a driving roller unit 71 of a film conveying portion 70, in which FIG. 6 (*a*) is a cross-sectional view, and FIG. 6 (*b*) is a side view.
Figure 6:
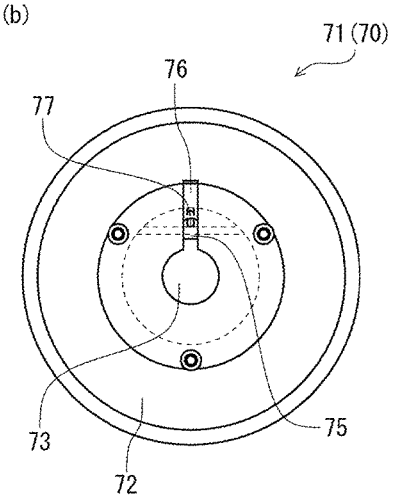

FIGS. 6 (*a*)-6 (*b*) are views illustrating a driving roller unit 71 of a film conveying portion 70, in which FIG. 6 (*a*) is a cross-sectional view, and FIG. 6 (*b*) is a side view.

Figure 7:
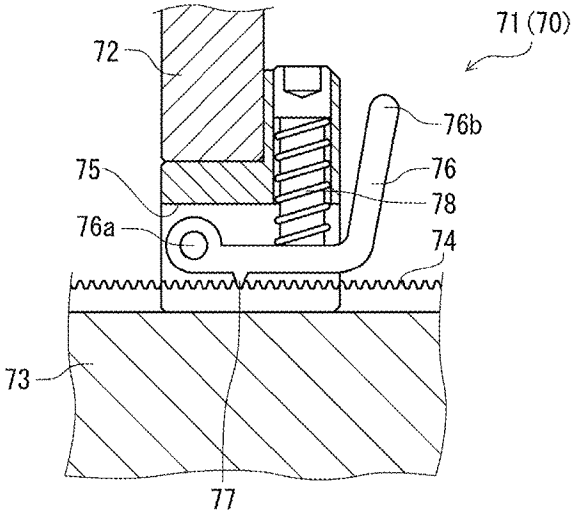
FIGS. 7 (*a*)-7 (*b*) are enlarged views of a rack gear 74, a piece 77 and the like (a) when engaged and (b) when disengaged.
Figure 7:
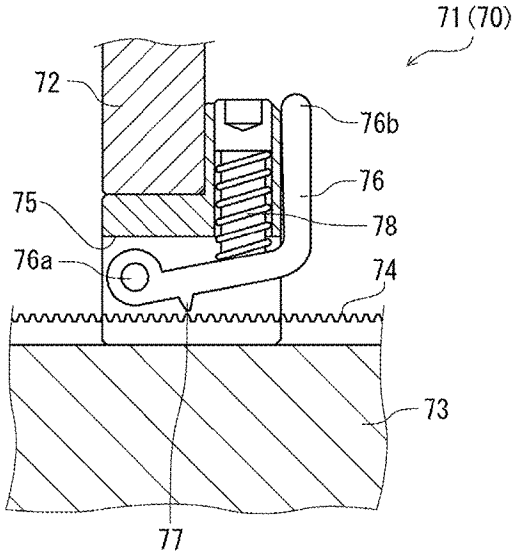

FIGS. 7 (*a*)-7 (*b*) are enlarged views of a rack gear 74, a piece 77 and the like (a) when engaged and (b) when disengaged.

The film conveying portion 70 includes the driving roller units 71 in the front and rear of the film F, respectively. Each driving roller unit 71 includes two driving rollers 72 and a drive rotation shaft 73 for rotating the driving rollers 72.

The drive rotation shaft 73 is a round bar member extending in the left-right direction, and transmits rotation force to the driving roller 72. The drive rotation shaft 73 has the rack gear 74 on its outer peripheral surface which is disposed along the axial direction (left-right direction). The rack gear 74 also acts as a key to secure the driving roller 72 to the drive rotation shaft 73.

The driving roller 72 has a central hole into which the drive rotation shaft 73 fits, and a key groove 75 is provided in a part of the central hole. By fitting the rack gear 74 into this key groove 75, the driving roller 72 is fixed to the drive rotation shaft 73 in the rotational direction and is supported to be able to move in parallel in the axial direction.

A lever 76, the piece 77, and a pressing spring 78 are arranged inside the key groove 75 of the driving roller 72.

The lever 76 is an L-shaped rod member whose first end 76*a* is rotatably fixed to a side wall of the key groove 75 and whose second end 76*b* protrudes from the key groove 75. The first end side of the lever 76 extends along the rack gear 74, and the second end side of the lever 76 along the side surface of the driving roller 72.

When the second end 76*b* of the lever 76 is moved away from the side surface of the driving roller 72, a one end side of the lever 76 approaches the rack gear 74. When the second end 76*b* of the lever 76 is moved closer to the side surface of the driving roller 72, the one end side of the lever 76 moves away from the rack gear 74.

The piece 77 is a protrusion provided near the first end 76*a* of the lever 76 and has a shape of one tooth meshing with the rack gear 74. The piece 77 moves in the up-down as the first end side of the direction lever 76 swings. When the second end 76*b* of the lever 76 is moved away from the side surface of the driving roller 72, the piece 77 moves toward and meshes with the rack gear 74. As a result, the driving roller 72 is fixed to the drive rotation shaft 73 in the axial direction.

The lever 76 and the piece 77 act as leverage (a booster). That is, the first end 76*a* is the fulcrum, the piece 77 is the point of action, and the second end 76*b* is the point where force is applied. Even if the second end 76*b* of the lever 76 is operated with weak force, the piece 77 can be strongly pressed against the rack gear 74.

The pressing spring 78 is disposed on a bottom wall of the key groove 75, and its tip (lower end) abuts on the second end side of the lever 76. The pressing spring 78 presses the second end side of the lever 76 toward the rack gear 74. The action of the pressing spring 78 causes the rack 77 to permanently mesh with the rack gear 74 and set (fix) the position of the driving roller 72 in the left-right direction.

In order to feed out the film F smoothly downward without wrinkling it, it is necessary to adjust the positions of the four driving rollers 72 in the left-right direction. The positions of the four driving rollers 72 in the left-right direction are adjusted according to the type (material), thickness, and the like of the film F. In particular, for the pair of driving rollers 72 facing each other in the front-back direction, the positions in the left-right direction have to match exactly.

In the film conveying portion 70, when the operator moves the second end 76*b* of the lever 76 closer to the side surface of the driving roller 72, the mesh between the piece 77 and the rack gear 74 is released. This makes it possible to easily change the position of the driving roller 72 in the left-right direction. Then, when the operator releases the lever 76, the piece 77 automatically meshes with the rack gear 74 and the position of the driving roller 72 in the left-right direction is set. Therefore, the positions of the four driving rollers 72 in the left-right direction can be easily and reliably adjusted.

[Filling Portion 80]

The filling portion 80 continuously throws the content X into the inside (the accommodating portion G5) of the tube-shaped film F on the lower side of the film conveying portion 70.

The filling portion 80 includes a filling pump 81 and a filling nozzle 82. The filling pump pumps the content X toward the filling nozzle 82.

The filling nozzle 82 is folded into the U shape from the right side of the bottom folding unit 30 (trapezoidal plate 32) and inserted into the inside of the film F. The filling nozzle 82 extends straightly downward from the bottom folding unit 30 and reaches below the film conveying portion 70.

The filling portion 80 drives the filling pump 81 to continuously discharge the content X from the filling nozzle 82 toward the inside of the tube-shaped film F.

[Squeezing Roller Portion 90]

Figure 8:
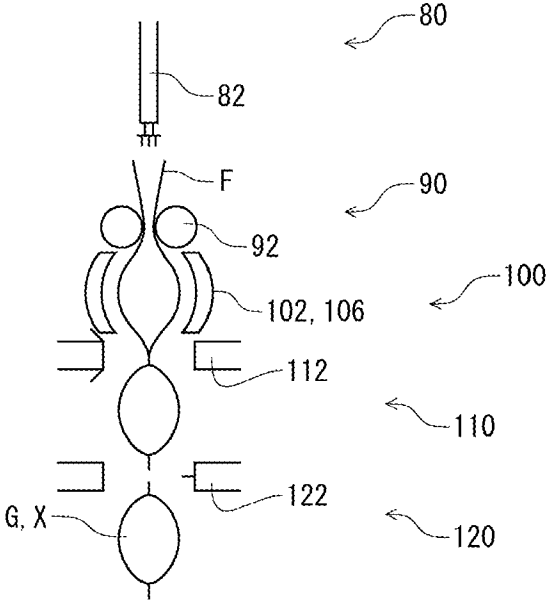
FIG. 8 (*a*) is a side view illustrating portions between a squeezing roller portion 90 and a cutter portion 120, and FIG. 8 (*b*) is a perspective view illustrating a correcting portion 100.
Figure 8:
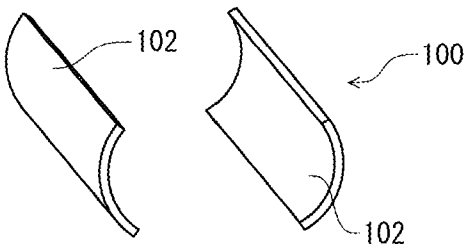

FIG. 8(*a*) is a side view illustrating portions between a squeezing roller portion 90 and a cutter portion 120, and FIG. 8(*b*) is a perspective view illustrating a correcting portion 100.

The squeezing roller portion 90 is disposed below the filling nozzle 82 and squeezes the tube-shaped film F filled with the content X.

The squeezing roller portion 90 includes a pair of squeezing rollers 92 extending in the left-right direction and feeds the tube-shaped film F downward with clamping it by the pair of squeezing rollers 92 in the front-back direction. As a result, the content X filled in the tube-shaped film F is vertically divided by the pair of squeezing rollers 92.

The tube-shaped film F is made flat and is conveyed toward the side seal portion 110. This makes it possible to reliably form the side seal S on the film F.

[Correcting Portion 100]

The correcting portion 100 is disposed immediately below the squeezing roller portion 90 and corrects a filled shape of the tube-shaped film F filled with the content X. The correcting portion 100 presses the filled shape of the tube-shaped film F from the front-back direction before the squeezing roller portion 90 is operated. The content X is reliably spread to the top gusset G3 and the bottom gusset G4 of the tube-shaped film F. Then, the filled amount of the content X enclosed in the tube-shaped film F is made stable.

The correcting portion 100 includes a pair of correcting plates 102. As shown in FIG. 8(*b*), the pair of correcting plates 102 are plate members extending in the left-right direction and disposed to face each other with clamping the film F in the front-back direction. The pair of correcting plates 102 are symmetrical with respect to the film F. Specifically, the correcting plates 102 have a half-cylindrical shape and forms a substantially elliptic space between them when they approach each other.

The correcting plate 102 presses a portion of the tube-shaped film F from the bottom gusset G4 to the top gusset G3 (accommodating portion G5). When the film F filled with the content X is pressed by the correcting plates 102, the filled shape of the film F is corrected to the substantially elliptic shape.

After the correcting portion 100 presses the tube-shaped film F, the squeezing roller portion 90 presses the film F flat. As a result, the filled amount of the content X enclosed in the film F is made stable.

[Side Seal Portion 110]

The side seal portion 110 is disposed below the correcting portion 100. The side seal portion 110 heat-welds, in the left-right direction, the film F pressed flat by the squeezing roller portion 90 so as to form the side seal S. The lower and upper parts of the film F are sealed by the side seal S, respectively, so that a complete bag body (film packaging bag G) is formed.

Moreover, the side seal portion 110 also forms the side seal S of the subsequent film packaging bag G. The side seal S of a tube-shaped film F becomes a bottom of another tube-shaped film F in the upper direction thereof.

The side seal portion 110 includes a pair of side heater bars 112. The pair of side heater bars 112 extends in the left-right direction and is disposed to face each other with clamping the film F in the front-back direction.

The pair of side heater bars 112 heat-welds the tube-shaped film F so as to form the side seal S extending in the left-right direction. The side seal S is formed so that the left and right ends overlap the seal T3 and the seal B3. As a result, the tube-shaped film F is sealed over the left-right direction, and the lower end of the film F becomes the bag body (film packaging bag G).

[Cutter Portion 120]

The cutter portion 120 is disposed below the side seal portion 110. The cutter portion 120 cuts off the bag body (film packaging bag G) from the film F.

The cutter portion 120 includes a pair of cutter bars 122. The pair of cutter bars 122 extends in the left-right direction and is disposed to face each other with clamping the film F in the front-back direction. The pair of cutter bars 122 divides the side seal S (including the seal T3 and the seal B3) of the film F into two parts in the up-down direction. As a result, the film packaging bag G is cut off from the film F.

[Manufacturing Method of Film Packaging Bag G with Contents]

Subsequently, a step of manufacturing the film packaging bag G with contents by using the vertical bag-making/filling/packaging machine 1 will be described.

Figure 9:
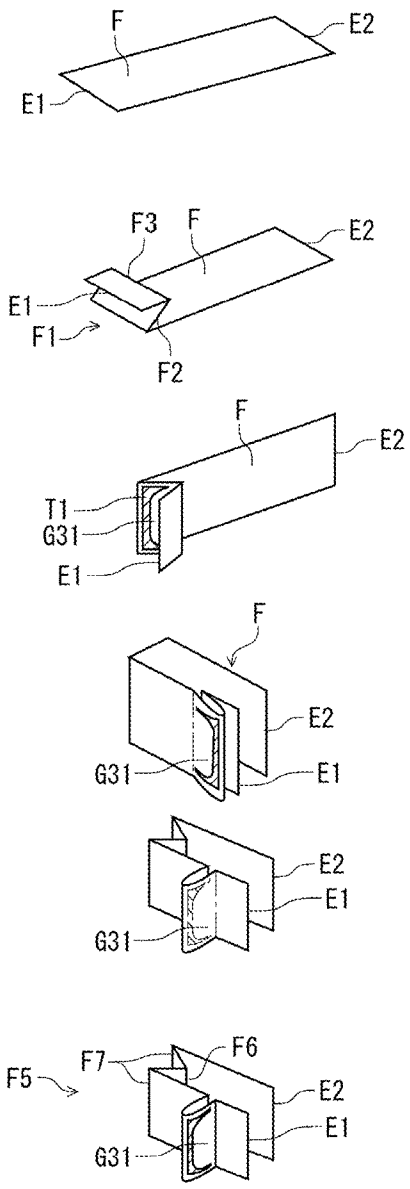
FIGS. 9 (*a*)-9 (*f*) are a schematic diagram illustrating steps from a top folding step S2 to a bottom folding step S3 in a manufacturing method of a film packaging bag G with contents according to an embodiment in order of the steps.

FIGS. 9 (*a*)-9 (*f*) are a schematic diagram illustrating a top folding step S2 and a bottom folding step S3 in a manufacturing method of the film packaging bag G with contents in order of the steps according to an embodiment.

Figure 10:
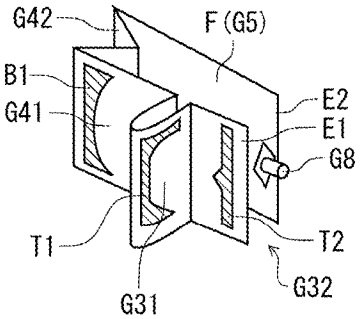
FIGS. 10 (*a*)-10 (*c*) are a schematic diagram illustrating steps from a mouth plug mounting step S4 to a bottom seal step S6 in the manufacturing method of the film packaging bag G with contents according to the embodiment in order of the steps.
Figure 10:
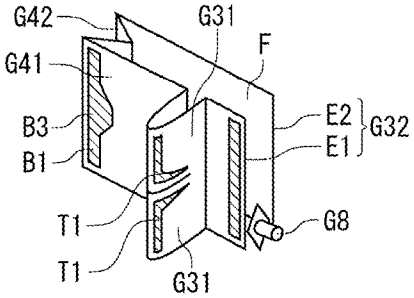
Figure 10:
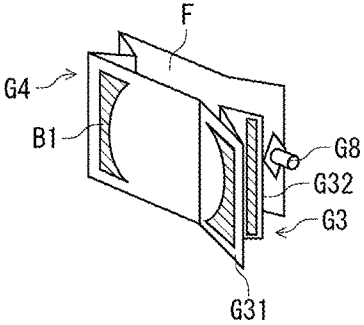
Figure 11:
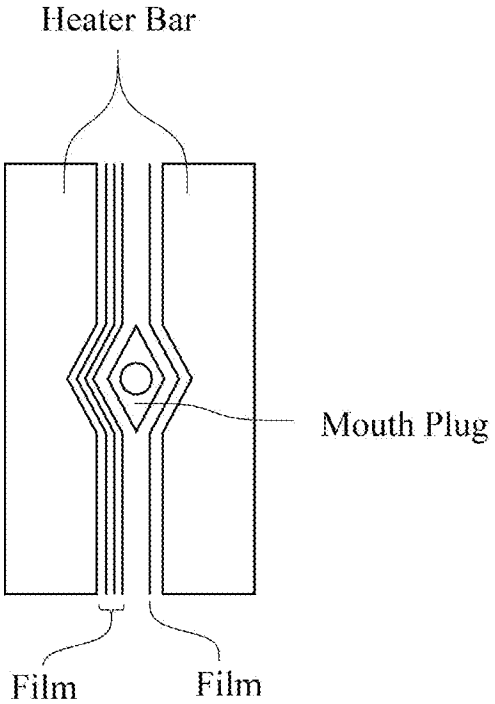
FIG. 11 is a schematic diagram illustrating a heat-welding step of a mouth plug for a conventional vertical bag-making/filling/packaging machine.

FIGS. 10 (*a*)-10 (*c*) are a schematic diagram illustrating steps from a mouth plug mounting step S4 to a bottom seal step S6 in the manufacturing method of the film packaging bag G with contents according to the embodiment in order of the steps.

For convenience of explanation, only a part of the film F (a part corresponding to one and the same film packaging bag G, etc.) is shown in FIGS. 9 and 10. Also, in order to make it easier to understand how the film F is folded, the close contact/welded portions are shown deformed (separated or opened).

The steps of manufacturing the film packaging bag G with contents includes a film supplying/conveying step S1, a top folding step S2, a bottom folding step S3, a mouth plug mounting step S4, a top seal step S5, a bottom seal step S6, a filling step S7, a correcting step S8, a squeezing step S9, a side seal step S10, and a separation step S11.

These steps are performed in the following order: the film supplying/conveying step S1, the top folding step S2, the bottom folding step S3, the mouth plug mounting step S4, the top seal step S5, the bottom seal step S6, the side seal step S10, the filling step S7, the correcting step S8, the squeezing step S9, the side seal step S10, and the separation step S11. The top seal step S5 and the bottom seal step S6 are performed almost simultaneously.

(Film Supplying/Conveying Step S1)

First, the band-shaped film F is fed out from a roll of the film supplying portion 10. The film conveying portion 70 intermittently conveys the film F toward the downstream side. The film F is sent out at a certain pitch. One pitch is the same as the length of the film packaging bag G in the left-right direction (lateral direction).

The film supplying/conveying step (conveying step) S1 is performed continuously.

(Top Folding Step S2)

As shown in FIGS. 9(*a*) and 9(*b*), the film F is folded with the one side in the width direction (side edge E1 side) into the Z shape (N shape) in the top folding unit 20. In the film F, the fold F1 for top gusset is formed via the folding-plate portion 22 and the pair of pressing rollers 24.

Moreover, as shown in FIG. 9(*c*), in the film F, the seal T1 is formed on the mountain fold F3 (top of the first pleat G31 and the like) of the fold F1 for top gusset via the first pleat seal portion 26. As a result, the first pleat G31 is formed on the fold F1 for top gusset.

(Bottom Folding Step S3)

Subsequently, as shown in FIG. 9(*d*), the film F has both sides pressed at a folding-plate portion 31 (the trapezoidal plate 32 and the pair of out guides 33) of the bottom folding unit 30 and is folded (doubled) into a U shape.

Then, as shown in FIG. 9(*e*), in the at the out guide 33, the first pleat G31 stands up on one side (on the side of the side edge E1) of the doubled film F (first pleat guide step).

The film sliding contact surface 34 of the out guide 33 applies tension onto the side (outer surface) of the film F by pressing it toward the inner surface side, while the slit groove 35 releases the tension on the first pleat G31. Thereby the first pleat G31 naturally stands up.

The out guide 33 inserts the first pleat G31 into the slit groove 35 opening in the film sliding contact surface 34 so as to separate the first pleat G31 from the second pleat G32 (the side edge E1 of the film F).

Subsequently, as shown in FIG. 9(*f*), in the film F, the center of the film F is pushed toward the side of the inner surface in the folding-plate portion 31 (the pushing plate 36 and the pair of holding plates 37), whereby the fold F5 for bottom gusset which is folded into an M shape (W shape) is formed.

Moreover, the film F goes through the pairs of pressing rollers 38 to be made flat.

The pair of pressing rollers 38 disposed on the right side brings the side edges E1 and E2 of the film F into close contact to each other in the front-back direction. The pair of pressing rollers 38 on the left side squeezes the portion of the film F folded into an M shape so as to form a fold (fold F5 for the bottom gusset).

Then, the film F is conveyed downward from the pairs of pressing rollers 38.

(Mouth Plug Mounting Step (Spout Portion Forming Step) S4)

As shown in FIG. 10(*a*), in the mouth plug mounting portion 40, a plastic mouth plug G8 is mounted between the side edges E1 and E2 of film F.

First, the mouth plug supplying portion 42 supplies and arranges the mouth plug G8 between the side edges E1 and E2 of the film F. The mouth plug supplying portion 42 temporarily separates the side edges E1 and E2 of the film F from each other and disposes the mouth plugs G8 therebetween at regular intervals.

Subsequently, the mouth plug fusion portion 44 heat-welds the mouth plug G8 to the side edges E1 and E2 so as to mount the mouth plug G8 on the film F.

(Top Seal Step S5)

Subsequently, as shown in FIG. 10(*a*), the top seals T (seals T2 and T3) are formed in the film F at the top seal portion 50.

As the seal T2 are formed in the film F, the second pleat G32 is assembled, and the film F is made into a tube shape at the same time. As the seal T3 are formed in the film F, the upper and lower ends of the first pleat G31 and the second pleat G32 (overlapping portion in which the film F is four-folded), respectively, are connected so as to assemble the top gusset G3.

First, the second pleat seal portion 51 forms the seal T2 by heat-welding the side edges E1 and E2 of the film F together and assembles the second pleat G32 (the second pleat seal step).

The second pair of top heater bars 52 clamps the side edges E1 and E2 of the film F with the mouth plug G8 therebetween. Then, the second pair of top heater bars 52 heat-welds the side edges E1 and E2 of the film F together to form the seal T2.

Subsequently, the pair of top cooler bars 53 clamps the mouth plug G8 in the front-back direction and cools the mouth plug G8 (the second pleat seal step).

As a result, the mouth plug G8 and the side edges E1 and E2 of the film F are rapidly solidified, and the mouth plug G8 is completely fixed to the film F.

Subsequently, as shown in FIG. 10(*b*), the pleat cutter 54 cuts the first pleat G31 in the horizontal direction to form cutting lines in the first pleat G31 from the top to the base thereof (the pleat cutter step).

When the pleat cutter 54 cuts the first pleat G31, the pleat supporter 55 supports (holds) the first pleat G31 in a forward upright position.

The pleat cutter 54 and the pleat supporter 55 makes the cutting lines in the first pleat G31 at regular intervals (length matching the width of the film packaging bag G) in the up-down direction.

Subsequently, as shown in FIG. 10(*c*), the second pleat guide 56 pushes the first pleat G31 down toward the second pleat G32 (the second pleat guide step).

The first pleat G31 is pushed down by the second pleat guide 56 and overlapped with the second pleat G32.

Finally, in the top reinforcing seal portion 57, the third pair of top heater blocks 58 heat-welds the upper and lower ends of the first pleat G31 and the second pleat G32, respectively, so as to form the seal T3 (the top reinforcing seal step).

The film F goes through the top seal portion 50 to form a tube, and the top gusset G3 is assembled.

(Bottom Seal Step S6)

Subsequently, as shown in FIGS. 10(*a*) to 10(*c*), the bottom seals B (seals T1 and T3) are formed in the film F at the bottom seal portion 60.

First, the first pair of bottom heater bars 62 heat-welds each of a pair of mountain folds F7 of the fold F5 for the bottom gusset (the first pleat G41 and the second pleat G42) so as to form a pair of seals B1.

Then, the second pair of bottom heater bars 64 heat-welds the upper and lower ends of the first pleat G41 and the second pleat G42 (overlapping portion in which the film F is four-folded), respectively, so as to form the seal B3.

The film F goes through the bottom seal portion 60 and the bottom gusset G4 is formed.

(Side Seal Step S10)

Subsequently, as shown in FIG. 8(*a*), the side seal S is formed in the film F at the side seal portion 110. The side seal portion 110 heat-welds the film F by the pair of side heater bars 112 so as to form the side seal S.

Thereby the bottom of the tube-shaped film F is formed.

(Filling Step S7)

Subsequently, as shown in FIG. 8(*a*), the film F is filled with the content X by the filling portion 80. When the film F is clamped by the pair of side heater bars 112, the filling portion 80 discharges the content X from the filling nozzle 82 into the film F so as to fill the film F with the content X.

(Correcting Step S8)

Subsequently, as shown in FIGS. 8(*a*) and 8(*b*), the film F has the filled shape corrected by the correcting portion 100. The film F is pressed by the pair of correcting plates 102 from the front-back direction in a state filled with the content X. As a result, the content X unevenly distributed inside the film F spreads to each corner of the inside of the film F.

The pair of correcting plates 102 presses a portion (accommodating portion G5) extending from the bottom gusset G4 to the top gusset G3. Since the pair of correcting plates 102 have symmetric half-cylindrical shapes with the film F between them, the filled shape of the film F is corrected to a substantially elliptic shape.

(Squeezing Step S9)

Subsequently, as shown in FIG. 8(*a*), the film F is squeezed by the squeezing roller portion 90.

The film F is clamped by the pair of squeezing rollers 92 disposed immediately above the correcting portion 100. The pair of squeezing rollers 92 waits while slightly separating from each other until the correcting portion 100 presses the film F. Then, after the filled shape of the film F is corrected by the correcting portion 100, the pair of squeezing rollers 92 is brought into close contact and presses the film F flat. As a result, the filled amount of the content X enclosed in the film F is made stable (fixed).

Subsequently, when the correcting portion 100 separates away from the film F, the film F is sent downward. The pair of squeezing rollers 92 maintains the state where the film F is pressed down. As a result, extra contents X remain in the upper direction of the pair of squeezing rollers 92.

(Side Seal Step S10)

Subsequently, as shown in FIG. 8(*a*), in the film F, the side seal S is formed in the side seal portion 110. The pair of side heater bars 112 heat-welds the film F pressed flat by the pair of squeezing rollers 92 and forms the side seal S. As a result, the lower end of the film F becomes a complete bag body (film packaging bag G).

(Separation Step S11)

Subsequently, as shown in FIG. 8(*a*), in the film F (film packaging bag G), the side seal S is cut off in the cutter portion 120. The cutter portion 120 divides the side seal S into upper and lower two parts. As a result, the film packaging bag G with contents is cut off from the film F.

As described above, the step of manufacturing the film packaging bag G with contents is completed.

The vertical bag-making/filling/packaging machine 1 repeats the steps of manufacturing the film packaging bag G with contents. As a result, the vertical bag-making/filling/packaging machine 1 continuously manufactures a plurality of the film packaging bags G with contents.

As described above, the vertical bag-making/filling/packaging machine 1 includes: the out guide 33A which pulls upright the first pleat G31 of the Z-shaped fold F1 for the top gusset formed in the band-shaped film F; the mouth plug mounting portion 40 which arranges (forms) the mouth plug G8 between the side edges E1 and E2 of the film F; and the second pleat seal portion 51 which heat-welds the side edges E1 and E2 together to form the second pleat G32 and make the film into a tube shape. As a result, it is possible to avoid the occurrence of defective welding even if one film F is disposed on the outer surface (rear surface) side of the mouth plug G8 and three films F are disposed in overlapping manner on the inner surface (front surface) side thereof. That is, when the mouth plug G8 is heat-welded between the side edges E1 and E2, the first pleat G31 (two films F) is pulled upright. As a result, only one film F is disposed on each of the outer surface side and the inner surface side of the mouth plug G8 at the time of the heat welding, so that the heating temperature becomes uniform and thus the mouth plug G8 can be favorably heat-welded.

The out guide 33A applies tension onto the outer surface of the film F by pressing it toward the inner surface side, while releasing the tension on the first pleat G31 to allow the first pleat G31 to stand on its own. As a result, the two films F (the first pleat G31) can be pulled off reliably from the three (triple) films F disposed on the inner surface (front surface) side of the mouth plug G8 to leave only one film F.

The bottom folding unit 30 has the out guide 33A which makes sliding contact with the outer surface of the film F to bring the sides of the film F closer together. This out guide 33A consists of the film sliding contact surface 34; and the slit groove 35 which opens in the film sliding contact surface 34 and extends in a direction crossing the film sliding contact surface 34 so as to allow the first pleat G31 to pass therethrough.

With such simple structural members, the two films F (the first pleat G31) can be pulled off reliably from the three (triple) films F to leave only one film F.

The vertical bag-making/filling/packaging machine 1 includes the first pleat seal portion 26 disposed between the top folding unit 20 and the bottom folding unit 30 for heat-welding the first pleat G31. This first pleat seal portion 26 heat-welds a longitudinal center of the first pleat G31 only at the top and both longitudinal ends from the top to a base. As a result, the first pleat G31 is fed toward the downstream while maintaining its shape without deflection or meandering during the conveyance.

The vertical bag-making/filling/packaging machine 1 includes: a second pleat guide 56 which tilts the first pleat G31 toward the second pleat G32; and atop reinforcing seal portion 57 which heat-welds both longitudinal ends of the first pleat G31 and the second pleat G32 together to form a top gusset.

The second pleat guide 56 tilts the first pleat G31 which has been pulled upright by the out guide 33A and overlap it over the second pleat G32. Therefore, the top reinforcing seal portion 57 can favorably heat-welds the four (quadruple) films F.

The vertical bag-making/filling/packaging machine 1 includes a pleat cutter 54 which is disposed above the second pleat guide 56 and cuts the first pleat G31 in the transverse direction at regular intervals. This makes it easier for the second pleat guide 56 to tilt the first pleat G31 toward the second pleat G32.

Since the vertical bag-making/filling/packaging machine 1 includes a pleat supporter 55 which supports the first pleat G31 in an upright position when the pleat cutter 54 cuts the first pleat G31, the pleat cutter 54 can cut the first pleat G31 accurately and reliably.

In the film conveying portion 70, the drive rotation shaft 73 includes a rack gear 74, and a driving roller 72 includes a piece 77 which meshes with the rack gear 74. This makes it possible to easily change the position of the driving roller 72 in the axial direction (left-right direction) with respect to the drive rotation shaft 73.

A lever 76, the piece 77 and a pressing spring 78 act as a booster (leverage), which makes it easier to press the piece 77 against and pull the piece 77 away from the rack gear 74.

By adjusting the elastic force of the pressing spring 78, the driving roller 72 can be firmly fixed to the drive rotation shaft 73.

Since the position of the driving roller 72 can be adjusted without a special tool, it is possible to avoid problems such as damage to other parts due to falling tools. In addition, it is possible to improve the efficiency of maintenance work and reduce the work time.

In the film packaging bag G with the content X, not only the bottom gusset G4 but also the top gusset G3 have two pleats (the first pleat G31 and the second pleat G32) with the same (uniform) fold width. This stabilizes the filling of the content X. Moreover, the mouth plug G8 is favorably fixed on the top of one pleat (the second pleat G32) without defective welding.

The present invention is not limited to the aforementioned embodiment but includes those with various modifications added to the aforementioned embodiment within a range not departing from the gist of the present invention. That is, specific shapes, configurations and the like cited in the aforementioned embodiment are only examples and capable of appropriate changes.

The film F is not limited to a band shape but may be an inflation film or the like. That is, the present invention is not limited to a case where the side edges E1 and E2 of the band-shaped film F are heat-welded into a tube shape. In addition, a plurality of the band-shaped films may be pasted together to form a tube-shaped film.

The content X is not limited to a liquid or a fluid (paste) but may be a liquid or a fluid containing a solid. The present invention may encompass a case where a liquid or a fluid is cooled to solidify, or the like.

The spout portion is not limited to being formed by arranging (fixing) the plastic mouth plug G8 between the side edges E1 and E2.

For example, a cut-off piece may be provided in a part (the seal T2, or the side edges E1 and E2) of the top seal T, and this spout may be cut off at the time of opening to form an aperture (an opening) communicating with the accommodating portion G5.

The film conveying portion 70 can be employed in not only the vertical bag-making/filling/packaging machine 1 provided with the bottom folding unit 30 but also other types of bag-making/filling/packaging machines. That is, the film conveying portion 70 may be employed in a bag-making/filling/packaging machine which has a former member bent in a sailor collar shape.

The driving roller unit 71 is not limited to having two driving rollers 72 per one drive rotation shaft 73. The number of the driving roller 72 can be set arbitrarily.

The lever 76 and the piece 77 (booster) are not limited to being disposed inside the key groove 75. These may be disposed on the side surfaces of the driving roller 72 or the like.

REFERENCE NUMERALS

1 Vertical Bag-Making/Filling/Packaging Machine
10 Film Supplying Portion
20 Top Folding Unit (Top Folding Portion)
26 First Pleat Seal portion
30 Bottom Folding Unit (Bottom Folding Portion)
33, 33A Out Guide
34 Film Sliding Contact Surface (First Pleat Guide)
35 Slit Groove (First Pleat Guide)
40 Mouth Plug Mounting Portion (Spout Portion-Forming Portion)
42 Mouth Plug Supplying Portion
44 Mouth Plug Fusion Portion
50 Top Seal portion
51 Second Pleat Seal portion
52 Second Pair Of Top Heater Bars (Pair Of Heater Bars)

53 Pair Of Top Cooler Bars (Pair Of Cooler Bars)
54 Pleat Cutter
55 Pleat Supporter
56 Second Pleat Guide
57 Top Reinforcing Seal portion
58 Third Pair Of Top Heater Blocks
60 Bottom Seal portion
70 Film Conveying Portion
71 Driving Roller Unit
72 Driving Roller
73 Drive Rotation Shaft
74 Rack Gear
75 Key Groove
76 Lever
77 Piece
78 Spring
80 Filling Portion
90 Squeezing Roller Portion
100 Correcting Portion
110 Side Seal portion
120 Cutter Portion
F Film
F1 Fold For Top Gusset (First Fold)
F2 Valley Fold
F3 Mountain Fold
F5 Fold For Bottom Gusset (Second Fold)
F6 Valley Fold
F7 Mountain Fold
E1, E2 Side Edge
G Film Packaging Bag (film Packaging Bag With Contents, Bag Body)
G3 Top Gusset
G31 First Pleat
G32 Second Pleat
G4 Bottom Gusset
G41 First Pleat
G42 Second Pleat
G5 Accommodating Portion
G8 Mouth Plug (Spout Portion)
T Top Seal
T1, T2, T3 Seal
B Bottom Seal
B1, B3 Seal
S Side Seal
X Content

The invention claimed is:

1. A vertical bag-making/filling/packaging machine comprising:

a top folding portion forming a first fold by folding one of sides of a band-shaped film into a Z shape;

a bottom folding portion folding a center of the film, wherein side edges of the film face each other;

a first pleat guide pulling a first pleat of the first fold upright;

a spout portion-forming portion forming a spout portion between the side edges of the film; and a second pleat seal portion forming a second pleat by heat-welding the side edges of the film together and making the film into a tube shape, wherein:

the first pleat and the second pleats have the same fold widths; and the first pleat guide presses an outer surface of the film toward an inner surface side to apply tension on the outer surface and release the tension on the first pleat, allowing the first pleat to stand on its own.

2. The vertical bag-making/filling/packaging machine according to claim 1, wherein the spout portion-forming portion comprises:

a mouth plug supplying portion disposing the mouth plug between the side edges of the film; and a mouth plug fusion portion heat-welding the side edges of the film to the mouth plug together.

3. The vertical bag-making/filling/packaging machine according to claim 2, wherein the second pleat seal portion comprises:

a pair of heater bars heat-welding the side edges of the film with the mouth plug therebetween; and a pair of cooler bars cooling the mouth plug and the side edges of the film.

4. The vertical bag-making/filling/packaging machine according to claim 1, wherein the bottom folding portion has an out guide which makes sliding contact with the outer surface of the film to bring the sides of the film closer together, and the first pleat guide includes a film sliding contact surface of the out guide and a slit groove opening in the film sliding contact surface and extending in a direction crossing the film sliding contact surface, allowing the first pleat to pass therethrough.

5. The vertical bag-making/filling/packaging machine according to claim 1, further comprising a first pleat seal portion disposed between the top folding portion and the bottom folding portion for heat-welding the first pleat, wherein the first pleat seal portion heat-welds a longitudinal center of the first pleat only at the top and both longitudinal ends from the top to a base.

6. The vertical bag-making/filling/packaging machine according to claim 1, further comprising:

a second pleat guide tilting the first pleat toward the second pleat; and a top reinforcing seal portion heat-welding both longitudinal ends of the first pleat and the second pleat together to form a top gusset.

7. The vertical bag-making/filling/packaging machine according to claim 1, wherein the bottom folding portion forms a second fold by folding the center of the film into an M shape, and the vertical bag-making/filling/packaging machine further comprises, below the bottom folding portion, a bottom seal portion forming a bottom gusset by heat-welding the second fold.

8. The vertical bag-making/filling/packaging machine according to claim 1, further comprising:

a film supplying portion supplying the film;

a film conveying portion conveying the film downward;

a filling portion discharging a fluid toward an inside of the film;

a side seal portion forming a bag body by heat-welding the film in a lateral direction; and a cutter portion cutting off the bag body from the film.

9. The vertical bag-making/filling/packaging machine according to claim 8, further comprising:

a correcting portion clamping the film in a front-back direction after introducing the fluid into the film to correct a filled shape of the film; and a squeezing roller portion disposed above the correcting portion and squeezing the film by pressing the film in the front-back direction.

10. The vertical bag-making/filling/packaging machine according to claim 1, further comprising a pleat cutter disposed below the second pleat seal portion to cut the first pleat in a transverse direction at regular intervals.

11. The vertical bag-making/filling/packaging machine according to claim 10, further comprising a pleat supporter supporting the first pleat in an upright position when the pleat cutter cuts the first pleat.

* * * * *